US012516583B2

(12) United States Patent
Michaud et al.

(10) Patent No.: US 12,516,583 B2
(45) Date of Patent: Jan. 6, 2026

(54) ROTATING CONTROL DEVICE RETAINING MECHANISM

(71) Applicant: Beyond Energy Services and Technology Corp., Calgary (CA)

(72) Inventors: George James Michaud, Beaumont (CA); Stewart George Wilson, Red Deer (CA); Charles Erle Norvila, Blackfalds (CA); Scott Evan Rypstra, Red Deer (CA)

(73) Assignee: Beyond Energy Services and Technology, Calgary (CA)

( * ) Notice: Subject to any disclaimer, the term of this patent is extended or adjusted under 35 U.S.C. 154(b) by 0 days.

(21) Appl. No.: 18/506,716

(22) Filed: Nov. 10, 2023

(65) Prior Publication Data

US 2025/0154847 A1 May 15, 2025

(51) Int. Cl.
*E21B 33/08* (2006.01)

(52) U.S. Cl.
CPC ..... *E21B 33/085* (2013.01)

(58) Field of Classification Search
CPC ..... E21B 33/03; E21B 33/038; E21B 33/085
See application file for complete search history.

(56) References Cited

U.S. PATENT DOCUMENTS

| | | | | |
|---|---|---|---|---|
| 11,686,173 | B2 * | 6/2023 | Tran | E21B 41/0021 166/378 |
| 11,753,895 | B2 | 9/2023 | Orbell et al. | |
| 2019/0093445 | A1 * | 3/2019 | Kulkarni | E21B 47/10 |
| 2020/0040689 | A1 * | 2/2020 | Yousef | E21B 4/003 |
| 2022/0381105 | A1 * | 12/2022 | Wilson | E21B 21/08 |

FOREIGN PATENT DOCUMENTS

| | | | |
|---|---|---|---|
| CA | 3111310 | A1 | 9/2022 |
| EP | 2295712 | A2 | 3/2011 |

* cited by examiner

*Primary Examiner* — Brad Harcourt
(74) *Attorney, Agent, or Firm* — Berg Hill Greenleaf Ruscitti LLP

(57) ABSTRACT

A rotating control device assembly comprises an outer member referred to as an RCD bowl or RCD housing, an inner member referred to as a sealing assembly housing or accessory, and at least two retaining members such as a ram block. A method of securing a sealing assembly or accessory inside a rotating control device apparatus comprises providing a rotating control device and manipulating the rotating control device to secure the sealing assembly or accessory.

21 Claims, 9 Drawing Sheets

ROTATING CONTROL DEVICE RETAINING MECHANISM

FIELD OF THE INVENTION

The present invention relates to a rotating control device retaining mechanism for use in the oil and gas industry, more specifically used in managed pressure drilling operations.

BACKGROUND OF THE INVENTION

When drilling for oil and gas, one encounters geological formations that have a narrower tolerance for changes in bottom hole pressure. Constant improvements are being sought to reduce any downtime of equipment and expedite any repairs that become necessary. A widely adopted solution to this problem is the so called 'Managed Pressure Drilling' (MPD). In this method of drilling, the annular space is closed to the atmosphere by means of a Rotating Control Device (RCD). Rotating equipment requires maintenance as the drilling environment produces forces, elevated temperatures and abrasive cuttings detrimental to the longevity of seals, bearings, and packing elements. An RCD is a pressure-control device used during drilling for the purpose of making a seal around the drillstring during its rotation and/or tripping in and out of a well. The RCD is designed to contain or divert hydrocarbons or other wellbore fluids and pressure and prevent their release to the atmosphere. The RCD diverts the fluid into a manifold equipped with a specialized choke that allows manipulation of the well's bottom hole pressure. Right before breaking a connection to add a new stand, the pumps are ramped down. At the same time, the dynamic component of the bottom hole pressure drops and needs to be compensated for, in order to maintain a near-constant bottom hole pressure.

In the oil and gas industry, it is paramount to ensure the safety of employees, a problem that may jeopardize employees' safety on a drilling rig is known as a "blowout". When a zone of high geopressure is encountered during a drilling operation and the pressure exceeds the hydrostatic pressure exerted by the drilling mud, and the formation has sufficient permeability to allow fluid flow, then the formation fluid will move into the wellbore and displace the drilling mud. This is referred to as a "kick"; and if unchecked it will result in a "blowout" which is an uncontrolled release of crude oil and/or natural gas from an oil well Through the use of an MPD system which includes an RCD a kick can be safely controlled.

During drilling operations, the drill pipe or tubular is axially and slidably moved through the rotating control head. The axial movement of the drill pipe along with other forces experienced in the drilling operation, some of which are discussed below, causes wear and tear on the bearing and seal assembly and the assembly subsequently requires repair. Typically, the drill pipe or a portion thereof is pulled from the well and the bearing and seal assembly in the rotating control head is then released.

The internal sealing elements may be either passive or active. Passive sealing elements, such as stripper rubber sealing elements, can be fabricated with a desired stretch-fit. On the other hand, an active sealing element typically requires a remote-to-the-tool source of hydraulic or other energy to open or close the sealing element around the outside diameter of the tubular. An active sealing element can be deactivated to reduce or eliminate the sealing forces of the sealing element with the tubular. Several types of RCDs have been proposed with combinations of active and passive seals or sealing element, usually combining a stripper rubber sealing element and an active sealing element.

A tubular typically comprises sections with varying outer surface diameters. The passive and active sealing elements mentioned above must be designed to adapt to seal around all of the rough and irregular surfaces of the components of the tubular, drill pipe, tool joints, and drill collars.

The continuous movement of the tubular through the sealing element while the sealing element is under pressure causes wear of the interior sealing surface of the sealing element. When drilling with a dual annular sealing element RCD, the lower of the two sealing elements is typically exposed to the majority of the pressurized fluid and cuttings returning from the wellbore, which communicate with the lower surface of the lower sealing element body. The upper sealing element is exposed to the fluid that is not blocked by the lower sealing element. When the lower sealing element blocks all of the pressurized fluid, the lower sealing element is exposed to a significant pressure differential across its body since its upper surface is essentially at atmospheric pressure when used on land or atop a riser. The highest demand on the RCD sealing elements occurs when tripping the tubular out of the wellbore under high pressure.

Several components are used to control the fluid pressure. Typically, one or more blowout preventers (BOP) are mounted with the well forming a BOP stack to seal the well. In particular, an annular BOP is used to selectively seal the lower portions of the well from a tubular that allows the discharge of mud. In many instances, a conventional rotating control head is mounted above the BOP stack. An inner portion or member of the conventional rotating control head is designed to seal and rotate with the drill pipe. The inner portion or member typically includes at least one internal sealing element mounted with a plurality of bearings in the rotating control head.

The thrust generated by the wellbore fluid pressure, the radial forces on the bearing assembly and other forces cause a substantial amount of heat to build in the conventional rotating control head. The heat causes the seals and bearings to wear and subsequently require repair. The conventional rotating control head typically includes a cooling system that circulates fluid through the seals and bearings to remove the heat.

EP patent application 2 295 712 A2 teaches a rotating control apparatus, comprising: an outer member; an inner member having a first sealing element and a second sealing element; said inner member, said first sealing element and said second sealing element rotatable relative to said outer member; a first cavity defined by said inner member, said first sealing element and said second sealing element; and said inner member having a port to said first cavity. The first sealing element being inflatable to adopt the configuration of the drill string during operations and deflatable to allow the drill string to pass through the RCD when tripping in or out of the wellbore.

Canadian patent application CA 3,111,310 discloses a rotating control apparatus, comprising: —an outer member (RCD bowl); and —an inner member (bearing assembly housing); said outer member comprising: —a top surface defining an aperture adapted to accommodate the insertion and removal of the inner member; —an inner circular surface defining a cavity; —a side wall; —an outer casing; —a bottom surface adapted for connection with a mud cross; —at least two sealing members capable of moving between a closed position and an open position, where the at least two sealing members are adapted to sealingly engage and lock said inner member inserted inside said cavity when in a closed position and allowing said inner member to be inserted therethrough or removed from the inner member when the at least two sealing members are in the open position; said inner member comprising: —a first sealing element and a second sealing element adapted to sealingly abut against said inner surface of said outer member; said inner member, first sealing element and second sealing element being rotatable relative to said outer member.

A later filed application which led to U.S. Pat. No. 11,753,895 B2 discloses a multipurpose latch assembly (MPLA) for installation above the bore of a blowout preventer includes an annular sidewall extending between a top flange and a bottom flange and having an interior bore surface defining an interior bore. It states that a plurality of latching slots extend through the sidewall and a latching dog is slidably positioned in each latching slot. Actuators are connected to the latching dogs to extend and retract them through the latching slots.

Despite the existing prior art, there still exists a need for a robust retaining mechanism for RCDs which when in operation allows for quick and secure installation and removal of RCD sealing assemblies and accessories. Preferably, the proposed RCD retaining mechanism should also be operable and able to determine positional status remotely to improve operational productivity and increase the personnel's safety around the wellbore.

SUMMARY OF THE INVENTION

Accordingly, there is provided an RCD system comprising a retaining mechanism which allows for quick and secure installation and removal of RCD sealing assemblies and accessories into and from an RCD housing.

According to an aspect of the present invention, there is provided a rotating control device (RCD) assembly comprising a retaining system, comprising:

an outer member (RCD bowl or RCD housing); and an inner member (sealing assembly housing or accessory);

at least two retaining members, such as a ram block;

said outer member comprising:

a top surface adapted for connection with a flange or clamp, which also defines an aperture having a first diameter adapted to accommodate the insertion and removal of the inner member;

an inner cylindrical surface defining a primary cavity and having a first diameter;

an inner circular side wall having a second diameter, said inner circular side wall being located directly under said inner cylindrical surface and inner circular said side wall comprising an inwardly and downwardly tapered section, located below said at least two retaining members;

an outer wall;

a bottom surface adapted for connection with a flange or clamp;

at least two secondary cavities extending through said inner cylindrical surface and outer wall each adapted to surround and support one of said at least two retaining members, said at least two secondary cavities being in connection with said primary cavity and being perpendicular thereto;

at least two retaining members (such as a ram block) capable of moving within a corresponding one of said at least two secondary cavities between a closed position and an open position, where said at least two retaining members are adapted to abut and lock said inner member inserted inside said primary cavity when in a closed position and allowing said inner member to be inserted into or removed from said primary cavity of said outer member when the at least two retaining members are in the open position;

a tapered landing profile which establishes a penultimate installation position of the inner member when such is inserted in said primary cavity and abutted thereon;

wherein said bottom surface being located below said at least two retaining members and having a third diameter, which is lesser than said first and second diameters;

wherein the at least two retaining members when moved from an open to a closed position abut with the inner member to move the inner member to a final retaining position said inner member comprising:

a first sealing element and a second sealing element adapted to sealingly abut against said inner circular side wall of said outer member; said inner member, first sealing element and second sealing element being rotatable relative to said outer member;

a bottom edge;

a circumferential slot, located proximate said bottom edge, comprising:

a cylindrical center section;

an upward and outward angled upper face adapted to abut with said retaining members when said at least two retaining members are moved from said open position to said closed position; and optionally, a downward and outward angled lower face adapted to abut with said retaining members when said at least two retaining members are moved from said open position to said closed position a bottom surface, optionally tapered, adapted to engage with said tapered landing profile of the outer member which establishes said penultimate installation position of the inner member;

said retaining member comprising:

an inner surface adapted and profiled to abut with said inner member;

a first and second side wall, where each one of said first and second side walls comprises a protrusion and a cavity adapted to mechanically engage with a cavity and a protrusion of an adjacent retaining member when said at least two retaining members are in the closed position;

a top surface having a downward and inward tapered edge a bottom surface optionally, having an upward and inward tapered edge a shape adapted to extend through said secondary cavity of said outer member and into said primary cavity of said outer member.

According to a preferred embodiment of the present invention, the bottom surface of the inner member abuts with the tapered landing profile of the outer member to establish said penultimate installation position, wherein said tapered landing feature providing an installation margin or window, negating the effect of an accumulation of material. Preferably, said tapered landing profile is also radiused.

According to a preferred embodiment of the present invention, each one of said at least two retaining members being actuated by a piston adapted to move the retaining member from the open position to the closed position. According to a preferred embodiment of the present invention, the retaining member assembly (ram block cylinder assembly) comprises: a cylinder housing, and a piston-rod arrangement.

According to a preferred embodiment of the present invention, cylinder housing comprises the means to move the retaining member (ram block) from a first position where the retaining member (ram block) is fully retracted within the outer member of the rotating control apparatus and a second position where the retaining member (ram block) is extended to a closed position into said main cavity.

According to a preferred embodiment of the present invention, when each one of said at least two retaining members is moved from said open position to said closed position, the top surface of the retaining member having a downward and inward tapered edge abuts on the upward and outward tapered edge of the circumferential slot of the inner member, causing the inner member to be driven axially upward to its final retained position.

According to a preferred embodiment of the present invention, when said at least two retaining members are in the closed position they effect a complete circular abutment with the cylindrical center section of the circumferential slot of the inner member.

According to a preferred embodiment of the present invention, when said at least two retaining members are in the closed position they affix the inner member in place and prevent any axial movement of said inner member within the primary cavity.

According to a preferred embodiment of the present invention, when said at least two retaining members are in the closed position, radial force is maintained to the inner member to restrict rotational movement of the inner member in relation to the outer member by frictional contact between the inner surface of said at least two retaining members and the cylindrical surface of the circumferential slot of the inner member.

According to a preferred embodiment of the present invention, when said at least two retaining members are in the closed position, radial force is maintained to the inner member to restrict rotational movement of the inner member in relation to the outer member by frictional contact between said retaining member top surface having a downward and inward tapered edge and the upward and outward angled upper face of the circumferential slot of the inner member and the retaining member bottom surface optionally, having an upward and inward tapered edge and the optionally downward and outward angled lower face of the inner member.

According to a preferred embodiment of the present invention, each one of said plurality of ram blocks are in the closed position in the absence of said inner member (i.e. with no inner member installed), each one of said at least two retaining members are mechanically interlocked with an adjacent retaining member to form a complete circular aperture which has a diameter smaller than the seal receiving diameters (said second diameter) of the outer member to protect these surfaces from contact by objects moving axially through the primary cavity of the outer member.

According to a preferred embodiment of the present invention, the piston/rod arrangement extends both inwardly and outwardly from the ram block cylinder assembly. Preferably, the cylinder housing includes an integral cavity adapted to accept a cartridge valve with load holding/locking functionality.

According to a preferred embodiment of the present invention, the means to move said retaining member are selected from the group consisting of devices adapted to impart linear movement comprising one or more of the following means of actuation: air-actuated; hydraulic; electrical; a wormgear or any other actuator adapted for this purpose.

According to a preferred embodiment of the present invention, the retaining member comprises a body and a concave front surface adapted to abut against the cylindrical surface of an inner member circumferential slot when in the closed position.

According to a preferred embodiment of the present invention, the ram block further comprises two side surfaces each of which having a protrusion and a cavity adapted for interlocking into a corresponding cavity and a corresponding protrusion of an adjacent retaining member.

According to a preferred embodiment of the present invention, the body of said retaining member comprises two opposite sides, a top, a bottom, and a seal which surrounds the retaining member body to provide a sealing engagement with an outer member secondary cavity to prevent fluid and solids migration between the wellbore and the cylinder chamber.

According to a preferred embodiment of the present invention, each one of said at least two retaining members further comprise a seal on said concave front surface.

According to another aspect of the present invention, there is provided a process of securing a sealing assembly or accessory inside a rotating control device assembly, said method comprising the steps of:

- providing a RCD assembly comprising a retaining system, said assembly comprising:
  - an outer member (RCD bowl or RCD housing);
  - an inner member (sealing assembly housing or accessory);
  - at least two retaining members, such as a ram block;
  - said outer member comprising:
    - a top surface adapted for connection with a flange or clamp, which also defines an aperture having a first diameter adapted to accommodate the insertion and removal of the inner member;
    - an inner cylindrical surface defining a primary cavity;
    - an inner circular side wall having a second diameter, and said side wall comprising an inwardly and downwardly tapered section, located below said at least two retaining members;
    - an outer wall;
    - a bottom surface adapted for connection with a flange or clamp;
    - at least two secondary cavities extending through the inner cylindrical surface and outer wall adapted to surround and support said at least two retaining members, said secondary cavities being in connection with said primary cavity and being perpendicular thereto;
    - at least two retaining members capable of moving within a corresponding one of said at least two secondary cavities between a closed position and an open position, where the at least two retaining members are adapted to abut and lock said inner member inserted inside said primary cavity when in a closed position and allowing said inner member to be inserted into or removed from the outer member when the at least two retaining members are in the open position;
    - a tapered landing profile which establishes a penultimate installation position of the inner member when such is inserted in said aperture and abutted thereon;

wherein said bottom surface being located below said at least two retaining members and having a third diameter, which is lesser than said first and second diameters;

wherein the at least two retaining members when moved from an open to a closed position abut with the inner member to move the inner member to a final retaining position said inner member comprising:

a circular body;

a first sealing element and a second sealing element adapted to sealingly abut against said inner circular side wall of said outer member; said inner member, first sealing element and second sealing element surrounding said circular body and being rotatable relative to said outer member;

a bottom edge;

a circumferential slot, located above said bottom edge, comprising:

a cylindrical center section;

upward and outward angled upper face adapted to abut with said retaining members when said at least two retaining members are moved from said open position to said closed position; and optionally, a downward and outward angled lower face adapted to abut with said retaining members when said at least two retaining members are moved from said open position to said closed position optionally, a tapered bottom surface adapted to engage with the tapered landing profile of the outer member which establishes the penultimate installation position of the inner member said retaining member comprising:

an inner surface adapted and profiled to abut with said inner member;

a first and second side wall, where each one of the first and second side walls comprises a protrusion and a cavity adapted to mechanically engage with a cavity and a protrusion of an adjacent retaining member when said at least two retaining members are in the closed position;

a top surface having a downward and inward tapered edge a bottom surface optionally, having an upward and inward tapered edge a shape adapted to extend through said secondary cavity of said outer member and into the primary cavity of said outer member optionally, an outer groove adapted to accept a seal which engages on said one of at least two cavities extending through the side wall of said outer member.

inserting said inner member into said primary cavity;

abutting said bottom edge of said inner member onto said tapered landing profile of said outer member;

actuating said at least two retaining members to move such from an open position to a closed position;

wherein during said actuating step, each one of said at least two retaining members comprising a downwardly and inwardly tapered top surface which abuts against a top edge of said circumferential slot and further movement of the retaining members towards said cylindrical center section of said inner member lifts said bottom edge off of said tapered landing profile of said outer member;

stopping the movement of said at least two retaining members when such reach and abut against said cylindrical center section of said inner member; and optionally, stopping the movement of said at least two retaining members when such reach and abut against the ram block top surface having a downward and inward tapered edge and the upward and outward angled upper face of the circumferential slot of the inner member and the ram block bottom surface optionally, having an upward and inward tapered edge and the optionally downward and outward angled lower face of the inner member;

wherein, in the closed position, the bottom edge of said inner member does not abut against said tapered landing profile.

According to a preferred embodiment of the present invention, the circumferential slot, located above said bottom edge, comprising: a cylindrical center section does not comprise an upward and outward angled upper face adapted to abut with said retaining members when said at least two retaining members are moved from said open position to said closed position, but rather a straight edge preferably radiused, which is intended on abutting the top edge of the retaining member (ram block) and allowing the latter to lift the inner member to the final retained position. The upper face in the above embodiment may be less ideal but would be expected to work sufficiently well to achieve the purpose required from it.

Preferably, said cylindrical center section comprises a mid-point which, upon insertion of said inner member and abutment onto said tapered landing profile of said outer member, will be located in a position under a mid-point defined by said inner surface of said retaining member; and wherein, upon said retaining member being in a closed position and abutting against said cylindrical center section of said circumferential groove, said mid-point of said inner surface of said retaining member and said midpoint of said cylindrical center section of said circumferential groove will be in alignment.

According to another aspect of the present invention, there is provided a method of securing a sealing assembly or accessory inside a rotating control device apparatus, said method comprising the steps of providing said RCD assembly comprising a retaining system, said rotating control apparatus comprising:

an outer member (RCD bowl or RCD housing); and an inner member (such as a sealing assembly housing or accessory);

said outer member comprising:

a top surface adapted for connection with a flange or clamp, which also defines an aperture having a first diameter adapted to accommodate the insertion and removal of the inner member;

an inner cylindrical surface defining a cavity;

an inner circular side wall;

an outer wall;

a bottom surface adapted for connection with a flange or clamp, wherein said bottom surface being located below said side wall and having a second diameter, which is lesser than said first diameter;

at least two sealing and/or retaining members capable of moving between a closed position and an open position, where the at least two sealing and/or retaining members are adapted to abut and lock said inner member inserted inside said cavity when in a closed position and allowing said inner member to be inserted therethrough or removed from the inner member when the at least two sealing members are in the open position;

said inner member comprising:

a circular body;

a first sealing element and a second sealing element adapted to sealingly abut against said inner surface of said outer member; said inner member, first sealing element and second sealing element surrounding said circular body and being rotatable relative to said outer member;

wherein said side wall, having said first diameter, said side wall comprising an inwardly tapered section, located below said at least two retaining members, which connects to said bottom surface;

wherein each one of said at least two sealing and/or retaining members comprises a ram block adapted to extend through a side wall of the outer member and into the cavity;

wherein each ram block comprises an inner surface adapted to abut with said inner member and a first and a second side wall, where each one of the first and second side walls is adapted to mechanically engage with an adjacent ram block when said at least two sealing and/or retaining members are in the closed position;

wherein each ram block comprises a top surface having a downward tapered edge;

wherein each ram block comprises a bottom surface having an upward tapered edge;

inserting a tool inside said aperture until such an edge of said tool abuts against said inwardly tapered section located at the edge of said bottom section, said tool comprising circumferential slot around a bottom section thereof;

actuating said sealing members to move from said open position to said closed position;

wherein during the movement of said sealing members, said downward tapered edge of said top surface of said ram block moves the tool upwards as it abuts a top edge of the circumferential slot of said tool; thereby sliding the tool upwards and aligning the front face of said ram block with the circumferential slot of said tool.

According to a preferred embodiment of the present invention, the bottom surface of the inner member engages with the tapered landing feature of the outer member to establish the penultimate installation position.

According to a preferred embodiment of the present invention, said tapered landing feature may also be tapered and radiused. Said tapered landing profile being to provide an installation margin or window, which would overcome the inevitable accumulation (i.e. build up) of material or debris which would, in turn, prevent proper alignment of the ram block with the circumferential slot on the inner member. In such a case, the ram blocks would be unable to properly close and would leave the inner member largely unsecured and prone to breaking or damage or simply be unable to perform the desired operation, negating the effect of a buildup of solid material.

According to a preferred embodiment of the present invention, each one of the plurality of ram blocks is actuated by a piston adapted to move the ram block from the open position to the closed position.

According to a preferred embodiment of the present invention, when each one of the plurality of ram blocks is moved from the open position to the closed position, the top surface of the ram block having an inward and downward tapered edge abuts on the outward and upward angled edge of the circumferential slot of the inner member, causing the inner member to be driven axially upward to its final sealing and retaining position.

According to a preferred embodiment of the present invention, when the at least two retaining members are in the closed position they effect a complete abutment with the cylindrical center section of the circumferential slot of the inner member. Preferably, when the at least two retaining members are in the closed position they lock the inner member in place and prevent any longitudinal movement from said inner member within the cavity.

According to a preferred embodiment of the present invention, when each one of the plurality of ram blocks are in the closed position, radial force is maintained to restrict rotational movement of the inner member in relation to the outer member by friction between the inner surface of the ram block and the cylindrical surface of the circumferential slot of the inner member.

According to a preferred embodiment of the present invention, when each one of the plurality of retaining members (ram blocks) are in the closed position with no inner member installed, the plurality of ram blocks are mechanically interlocked with each other to form a complete circular aperture which has a diameter smaller than the seal receiving diameters of the outer member to protect these surfaces from contact by objects moving axially through the central bore of the outer member which would normally be accomplished by the use of a bore protector, sleeve, or other means of protection.

According to a preferred embodiment of the present invention, the ram block cylinder assembly comprises the ram block, cylinder housing, and piston/rod assembly.

According to a preferred embodiment of the present invention, the ram block cylinder assembly comprises the ram block, cylinder housing, and integral piston/rod assembly.

According to a preferred embodiment of the present invention, said piston/rod assembly extends both inwardly and outwardly from the ram block cylinder assembly. The outward extension serves as a means to detect the open or closed position of the ram block cylinder assembly. The inward extension serves as a means of attachment of the ram block.

According to a preferred embodiment of the present invention, the cylinder housing comprises the means to move the ram block from a first position where the ram block is fully retracted within the outer member of the rotating control apparatus and a second position where the ram block is extended into the aperture defined in the outer member.

According to a preferred embodiment of the present invention, the cylinder housing includes an integral cavity adapted to accept a cartridge valve with load holding/locking functionality.

Preferably, the means to move the ram block are selected from the group consisting of devices adapted to impart linear movement. According to a preferred embodiment of the present invention, the device adapted to impart linear movement is selected from the group consisting of: pneumatic; hydraulic; electrical; a wormgear or any other actuator adapted for this purpose.

According to a preferred embodiment of the present invention, the retaining member (ram block) comprises a body and a concave front surface adapted to abut against the cylindrical surface of an inner member circumferential slot when in operation. Preferably, the ram block further comprises two side surfaces each of which having a protrusion and a cavity adapted for insertion into the cavity and protrusion of an adjacent ram block. More preferably, the body of the ram block comprises two opposite sides, a top and a bottom and a seal which surrounds the body to provide a sealing engagement with the ram block housing and prevent fluid and solids migration between the wellbore and the cylinder chamber. Preferably, a barrier fluid fills the cavity (i.e. space) formed between the ram block housing seal and the device adapted to impart linear movement to further prevent fluid and solids migration between the wellbore and the cylinder chamber. The cavity formed between the ram block housing seal and the device adapted to impart linear movement is externally connected to an accumulator to form a closed system which accommodates the variable volume of the cavity as the ram block is moved between open and closed positions. Even more preferably, the ram block further comprises a seal on its front surface.

According to a preferred embodiment of the present invention, the cavity formed between the ram block housing seal and the device adapted to impart linear movement is filled with a barrier fluid to further prevent fluid and solids migration between the wellbore and cylinder chamber. The cavity formed between the ram block housing seal and the device adapted to impart linear movement is externally connected to an accumulator to form a closed system which accommodates the variable volume of the cavity as the ram block is moved between open and closed positions.

BRIEF DESCRIPTION OF THE FIGURES

The detailed description will be better understood in conjunction with the accompanying drawings as follows.

BRIEF DESCRIPTION OF A PREFERRED EMBODIMENT

The cost of incorporating an RCD into a rig is meant to be offset by avoiding the consequences of not having one. Reducing the number of incidents and increasing the speed of drilling translates into lower costs for operators and owners alike. RCDs also allows operators to use lower mud weights in high-pressure environments, which reduces the costs associated with mud as well as the volumes of mud required. RCDs also allows the exploitation of reservoirs which may be very difficult to access. The use of RCDs also provides an effective means of managing drilling hazards, as they are intended to provide a gas-tight seal that protects operators, employees and the environment. RCDs are designed to divert toxic gas, such as hydrogen sulfide, away from the rig floor to protect personnel present on the rig. RCDs also prevent gas influxes from reaching above the blowout preventer and entering the riser creating serious safety hazard situations.

According to a preferred embodiment of the present invention as illustrated in FIGS. 1 to 11, there is provided a RCD (1) having a main retaining mechanism assembly comprised of 6 ram blocks operating together to conform to the shape (preferably a cavity such as a circumferential slot located on exterior surface) of an inner member (4) being inserted into the RCD.

Figure 1:
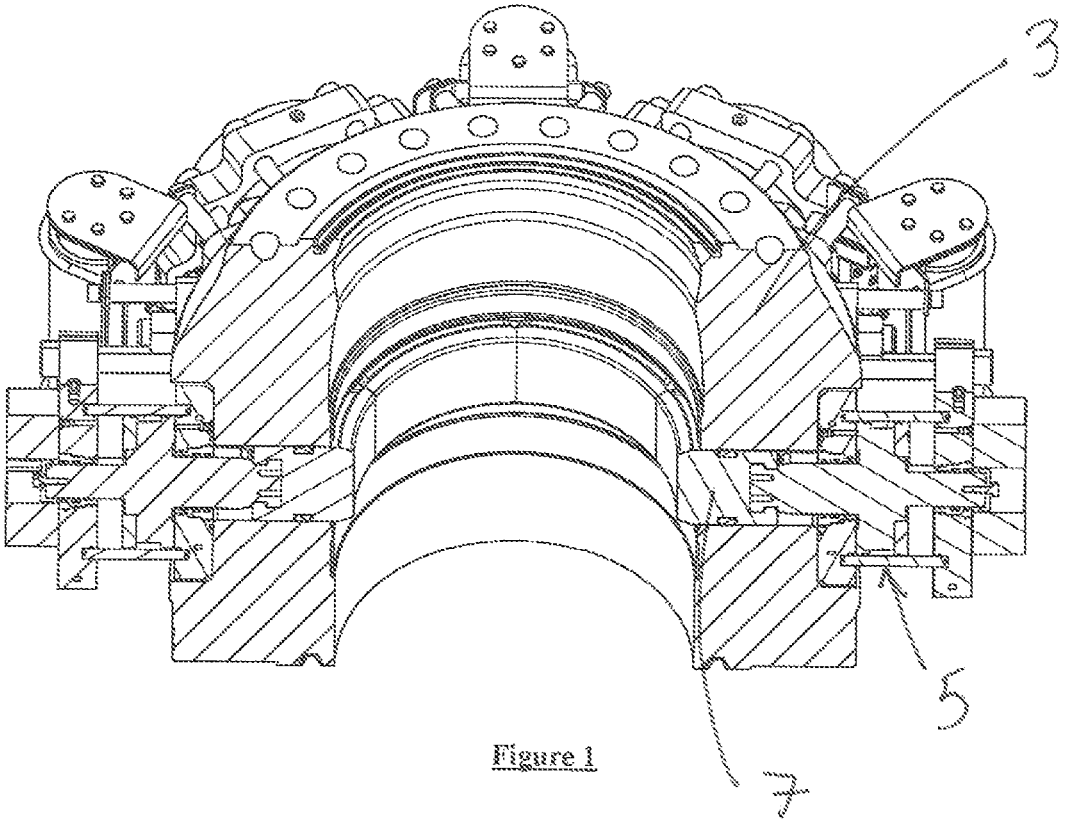
FIG. 1 is a top perspective cross-sectional view of an outer member for use in a RCD according to a preferred embodiment of the present invention.
Figure 2:
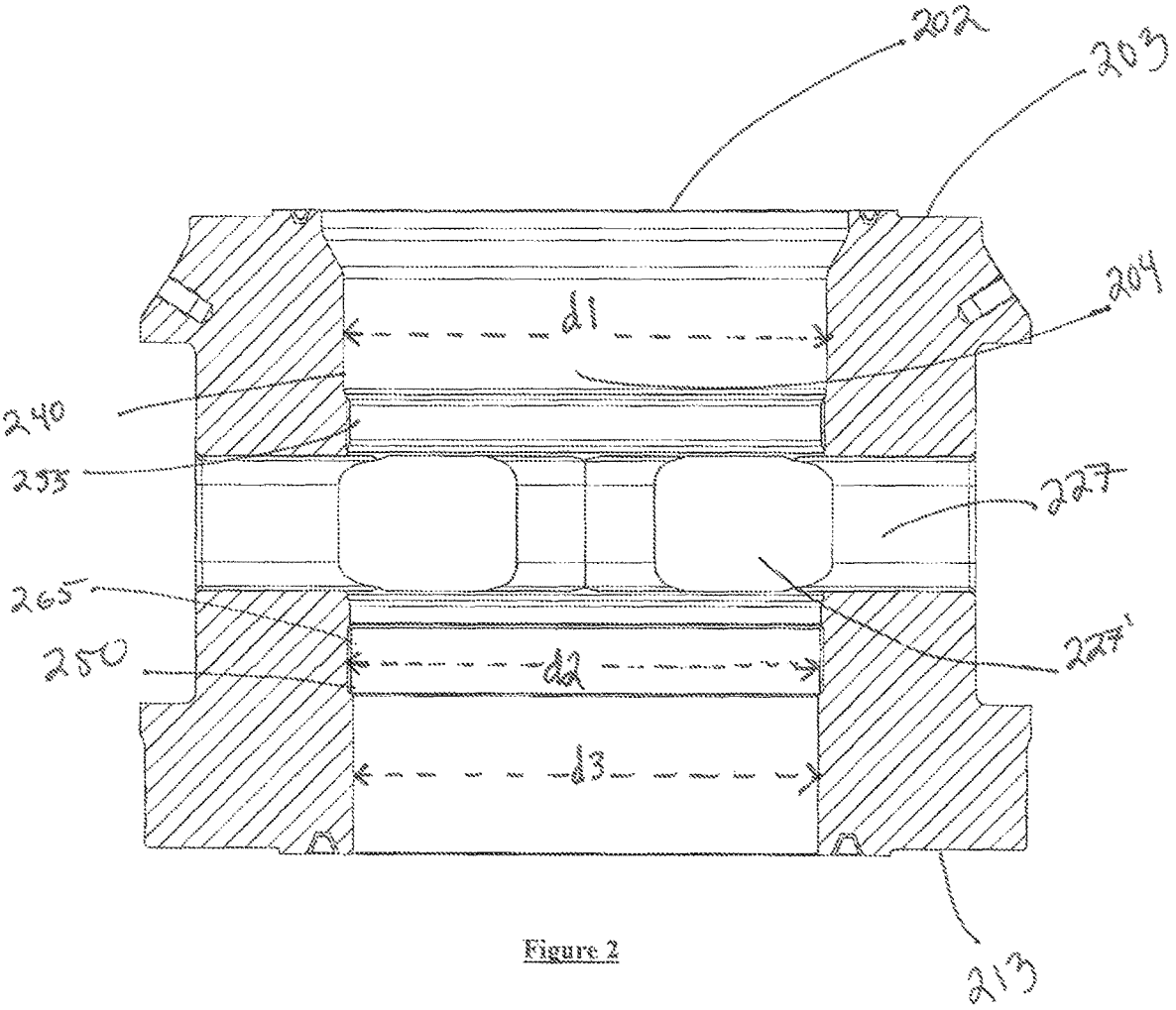
FIG. 2 is a cross-sectional view of an outer member for use in a RCD according to a preferred embodiment of the present invention.
Figure 11:
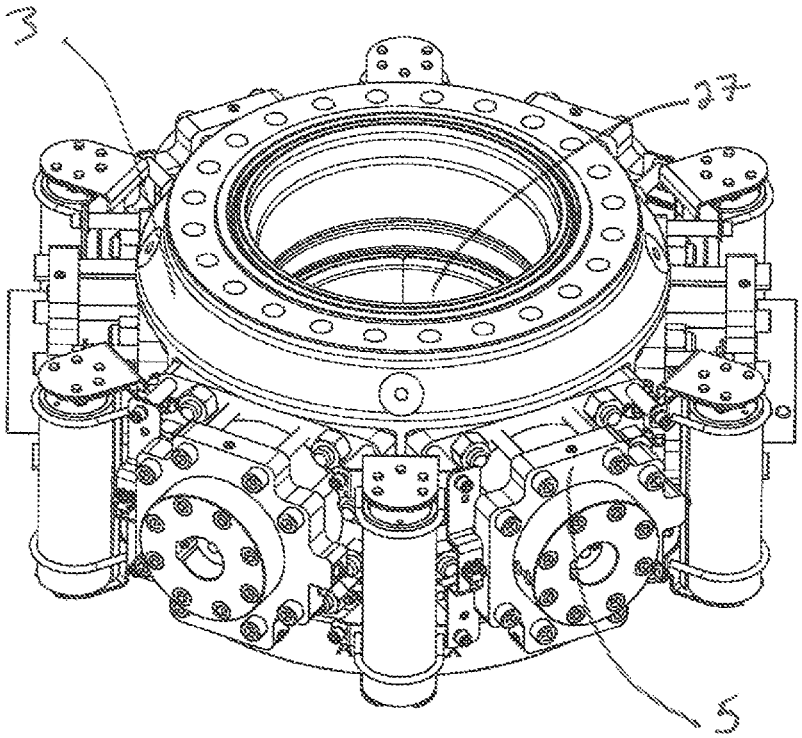
FIG. 11 is a front perspective view of an outer member for use in a RCD according to a preferred embodiment of the present invention.

FIG. 11 depicts a front perspective view of an outer member for use in a RCD according to a preferred embodiment of the present invention. This illustrated embodiment has 6 ram block cylinder assemblies (5). FIG. 1 depicts a cross-sectional view of an outer member for use in a RCD according to a preferred embodiment of the present invention. One can observe the ram block (7) and ram block cylinder assemblies (5) in the secondary cavities (227, 227'). FIG. 2 depicts a cross-sectional side view of the outer member (3) according to a preferred embodiment of the present invention where the secondary cavities (227, 227) can be clearly seen. One notes also the various diameters of the main cavity (204), a first diameter (d1) is located in the top surface (203) of the outer member (3) adapted for connection with a flange or clamp and continues until directly under the ram blocks (7), a second diameter (d2) located under the ram blocks after a transition segment, and a third diameter (d3) located under the tapered section also referred to as tapered landing profile (40) of the side wall (250) of the outer member (3). At the bottom of the outer member (3) there is the bottom surface (213) adapted for connection with a flange or clamp.

During the installation of a tool or passing a tubular through the RCD bowl (tripping in or out), the pistons moving the ram blocks are all actuated to move the ram blocks towards an "open" configuration where the inner surface of the ram blocks define a diameter inside the RCD which is at least as large or larger than the inner diameter of the RCD bowl. This allows the tool or tubular to move within the RCD bowl by minimizing the contact and friction against the high pressure radial seal bores and thus minimize the potential damage to the seals. The replacement of the high pressure seals remains the most common reason for the shutdown of operations and minimizing this occurrence directly translates in increased production and a decrease in operational costs.

According to a preferred embodiment of the present invention, the retaining members (or ram blocks) are present in such a way as to provide a good, robust interaction with the inner member nestled within the RCD bowl, i.e. inside the main cavity. Preferably, there are 6 ram blocks each of which is actuated by a piston. Consequently, there is a piston assembly for each ram block which provides the movement for the ram block.

According to a preferred embodiment of the present invention, the number of ram blocks is determined by the amount equipment allotted to operate the device. In some instances, it may be desirable to have fewer ram blocks and therefore, one could conceivably have only two ram blocks, each of which would cover half of the circumference of the tubular when in the closed position. Other embodiments may employ 3, 4, 5, 6 or even more ram blocks depending on the operating parameters such as sizing limitations.

Open Position

Figure 3A:
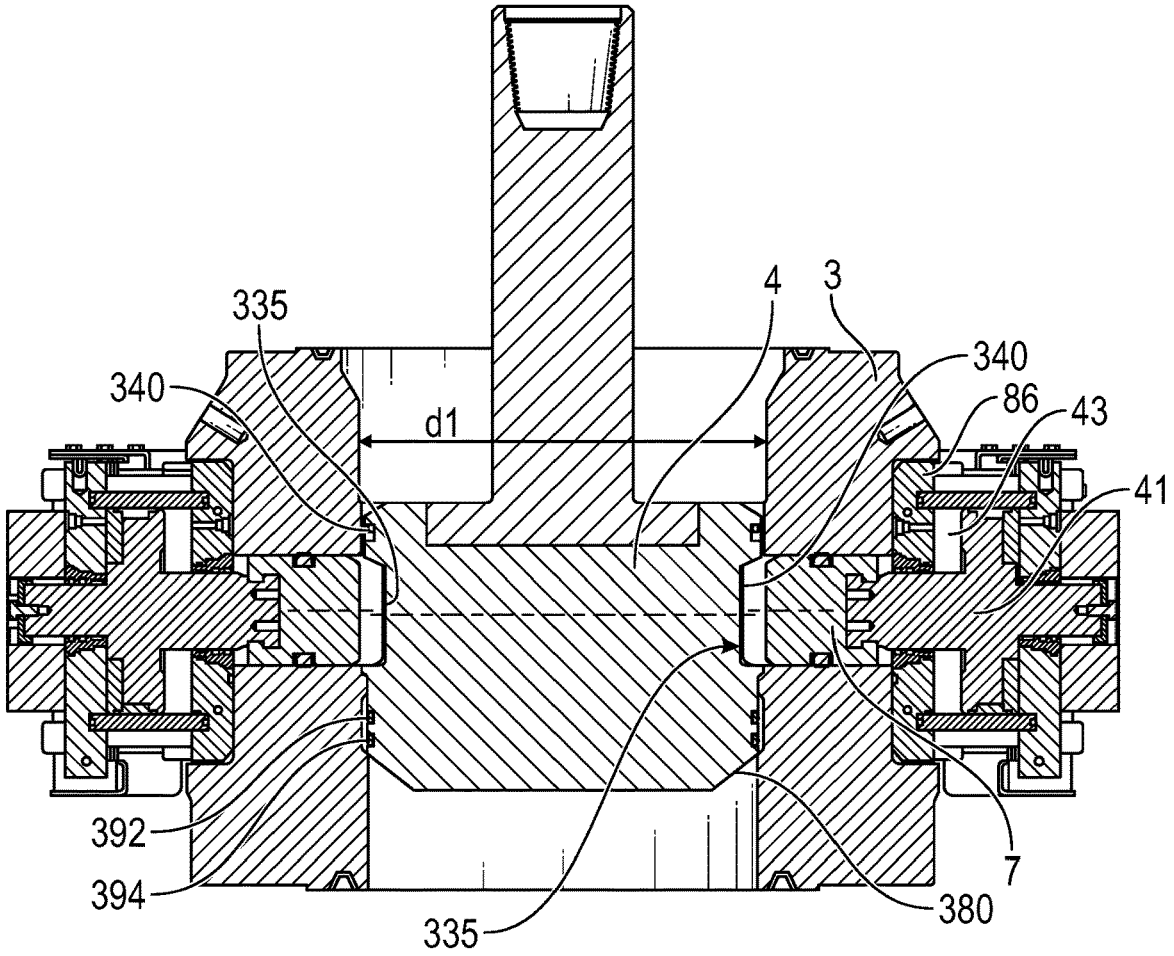
FIGS. 3*a*, 3*b* and 3*c* are respectively a cross-sectional view of an outer member (FIG. 3*a*), a close-up of the abutment of an inner member to the outer member (FIG. 3*b*) and a cross-sectional side view close up of the alignment of the midpoint of the retaining member with the midpoint of a circumferential slot on an inner member (FIG. 3*c*) according to a preferred embodiment of the present invention when the retaining members are in an open position and the inner member is in its penultimate insertion position.
Figure 3B:
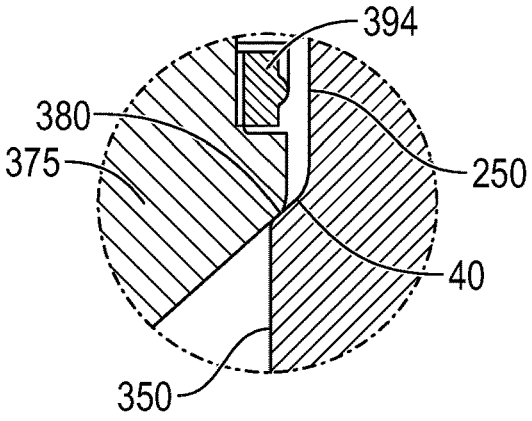
Figure 3C:
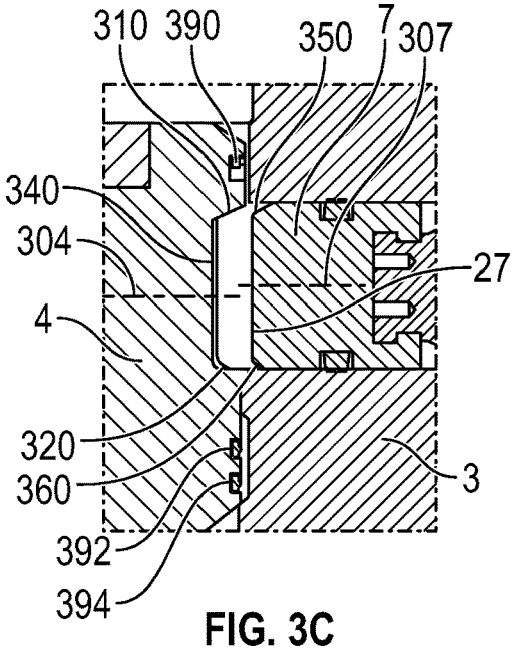

By referring to FIGS. 3*a* and 3*c*, one notes that inner (front) surface (27) of the ram block (7) is recessed beyond the inner diameter (d1) of the RCD bowl (outer member (3)). This is to allow the inner member to be inserted into the outer member. In FIG. 3*a*, when referring to the piston chamber (43), one notes that the piston (41) is completely recessed into the cylinder chamber (43).

According to another preferred embodiment, the piston may only be partially recessed within the piston chamber to allow the ram block to be fully opened.

The ram blocks (the retaining members) can also be retracted to an open position in order to allow an oversized tubular or tool, such as a drill bit, to pass through the RCD, that would otherwise not be able to pass through the inner diameter created when the ram blocks are extended in a closed position.

Figure 7:
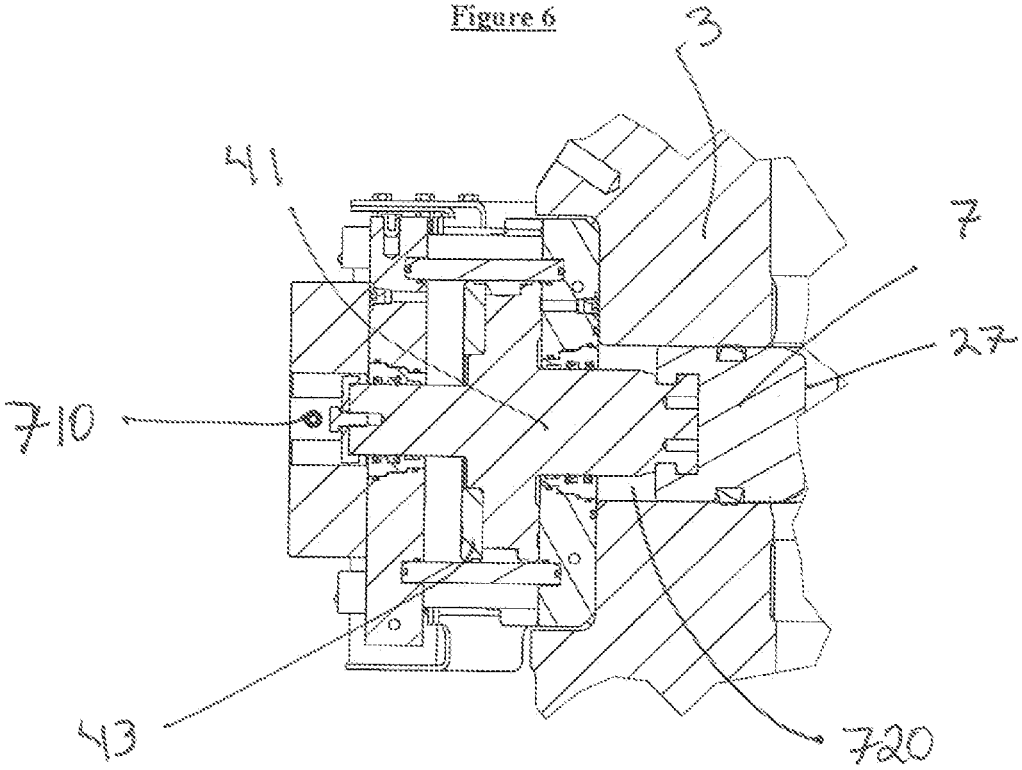
FIG. 7 is a cross-sectional side view of a ram block assembly and ram block cylinder assembly for use in a RCD according to a preferred embodiment of the present invention where ram block is in a fully extended closed position.
Figure 8:
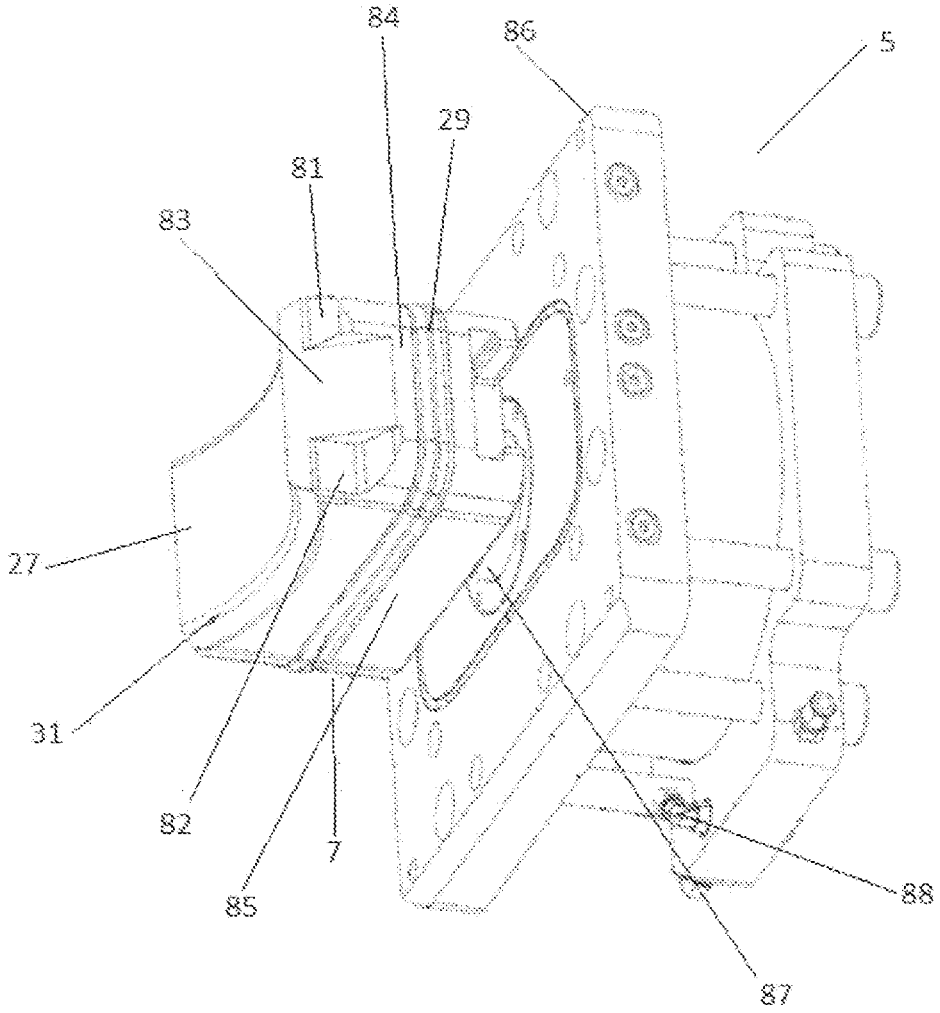
FIG. 8 is a side perspective view of a ram block assembly and ram block cylinder assembly for use in a RCD according to a preferred embodiment of the present invention.

As seen in FIG. 8, the ram block (7) preferably comprises sealing elements (29) which surrounds the entire ram body to prevent leakage of wellbore solids and fluids into the barrier fluid chamber (720) as seen in FIG. 7.

Intermediate Position

Figure 4A:
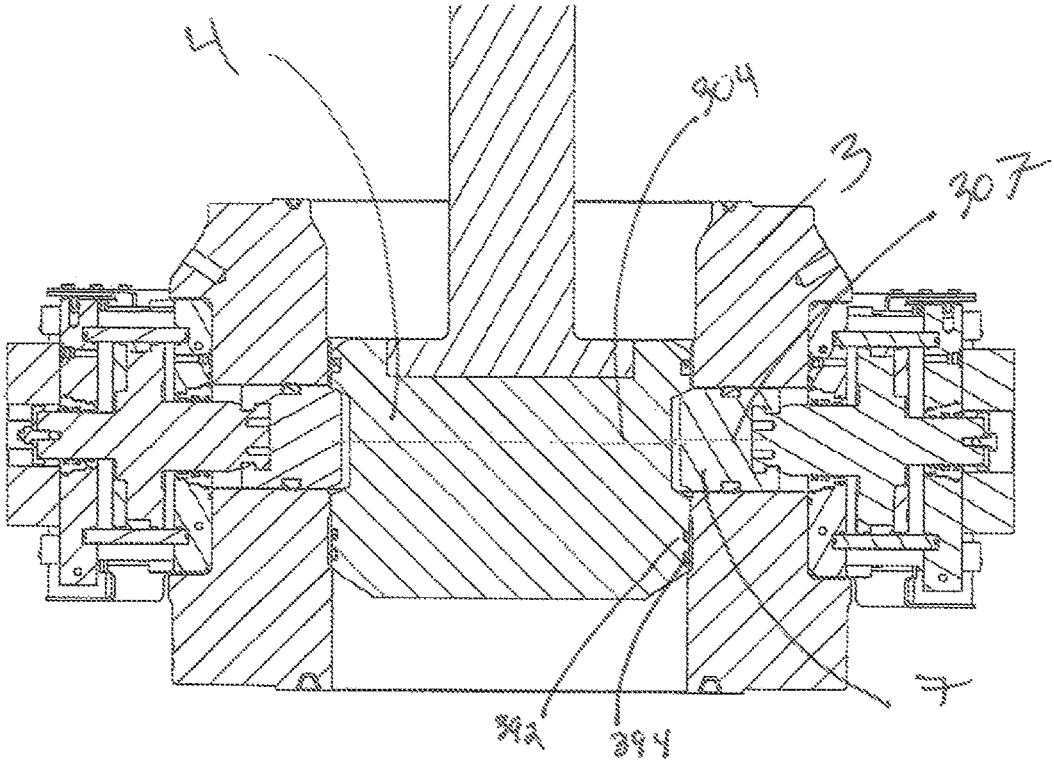
FIGS. 4*a*, 4*b* and 4*c* are respectively a cross-sectional view of an outer member (FIG. 4*a*), a close-up of the abutment of an inner member to the outer member (FIG. 4*b*) and a cross-sectional side view close up of the alignment of the retaining member with the midpoint of a circumferential slot on an inner member (FIG. 4*c*) according to a preferred embodiment of the present invention when the retaining members are abutting the top edge of the circumferential slot.
Figure 4B:
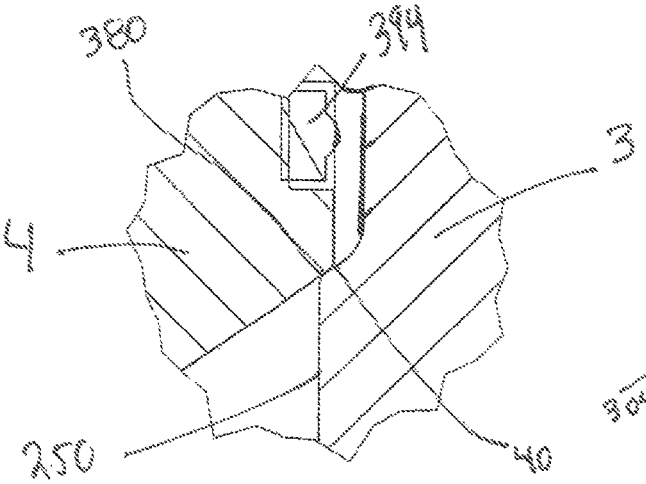
Figure 4C:
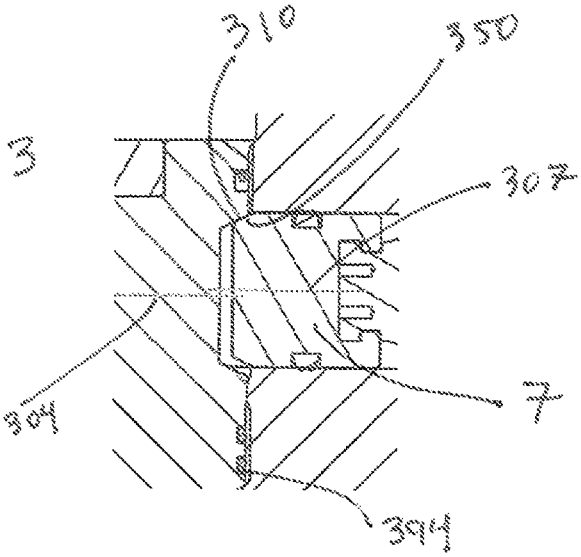

By referring to FIGS. 4*a*, 4*b* and 4*c*, there can be observed a gap (25) between the front surface of the ram block (7) and the cylindrical surface (340) of the circumferential slot (335) present on a lower section of the inner member (4). This indicates that the ram blocks have not secured the inner member (4) into a final position which is also referred to as locked or closed position.

By referring to FIG. 4*b*, one can see that the bottom edge (380) of the inner member (4) is abutted against the tapered edge (40) of the outer member (3). This tapered edge (40) is designed so as to act as a stop when an inner member is inserted into the primary cavity (204) of the outer member (3). At this point, and upon referring to FIG. 4*c*, one notes that the midpoint (304) of the circumferential slot (335) is currently not aligned with the midpoint (307) of the ram block (7). It is this deliberate "misalignment" which is corrected upon the actuation of the ram block (7) from an open position (See FIG. 3*a*) to a completely closed position (see FIG. 5*a*). This type of arrangement overcomes the drawbacks of having a square shoulder whereon the edge of the inner member rests upon insertion and prior and after to the actuation of ram blocks. Such a system requires alignment of the circumferential slot and of the ram block upon an inner member reaching the shoulder. Moreover, a square shoulder is necessarily prone to the accumulation of debris thereon. Such accumulation of debris would lead to an unintentional mis-alignment of the circumferential slot and of the ram block and would prevent the ram blocks from securing the inner member and thus prevent any operation from proceeding. Such a situation would normally require maintenance of the outer member, including insertion of a tool therein to remove the accumulation of debris or even more drastic situations would require removal of the outer member for maintenance. Any type of avoidable maintenance constitutes an unnecessary drag on operations and costs which only render operations using such assemblies less competitive.

According to the illustrated embodiment in FIG. 4*c*, the downward tapered top surface (350) of the ram block (7) engages with the upward angled edge of the circumferential slot (310) of the inner member (4). Further linear movement of the ram block (7) towards the cylindrical surface (340) of the circumferential slot (335) further lifts the inner member (4) until the front surface (27) of the ram block (7) abuts against the cylindrical surface (340) of the circumferential slot (335).

Closed Position

Figure 5A:
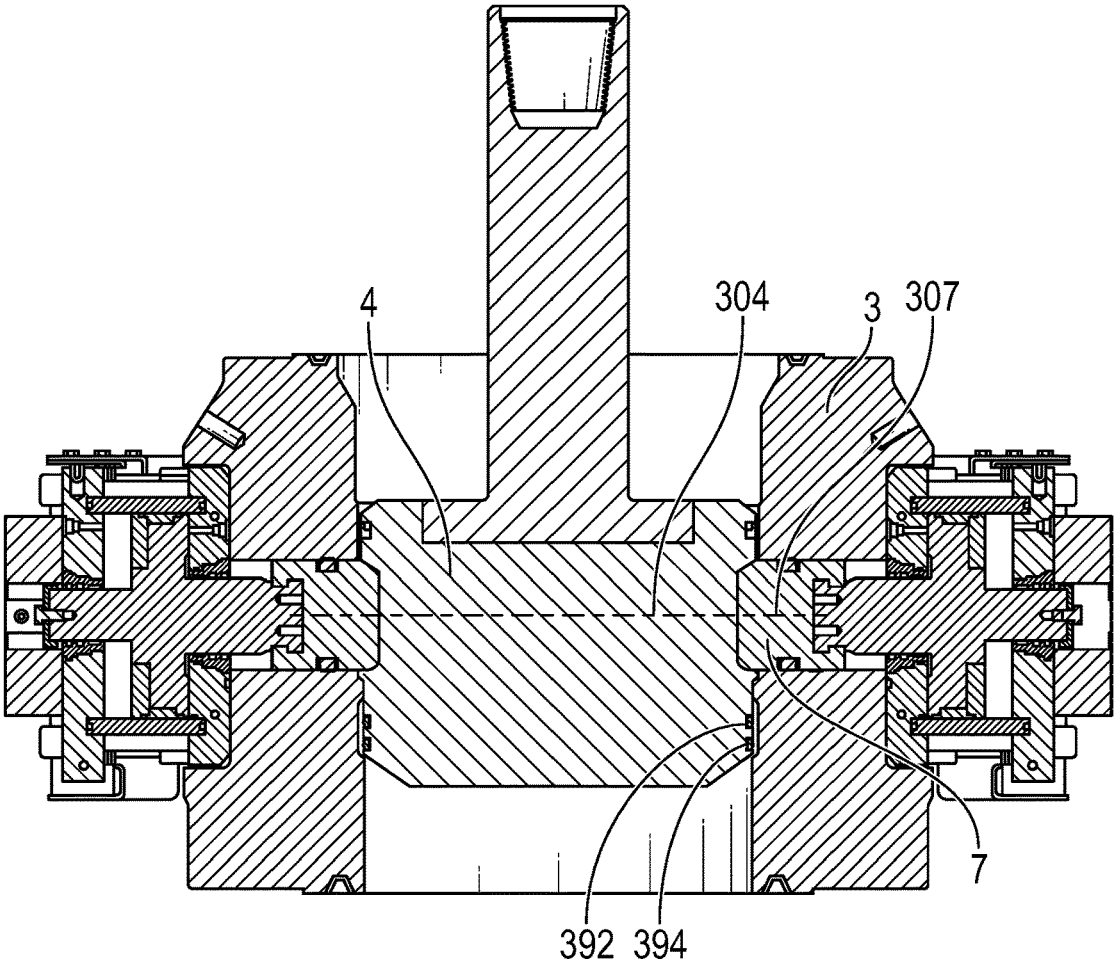
FIGS. 5*a*, 5*b* and 5*c* are respectively a cross-sectional view of an outer member (FIG. 5*a*), a close-up of the abutment of an inner member to the outer member (FIG. 5*b*) and a cross-sectional side view close up of the alignment of the retaining member with the midpoint of a circumferential slot on an inner member (FIG. 5*c*) according to a preferred embodiment of the present invention when the retaining members are in a closed position abutted against the circumferential slot of the inner member.

By referring to FIG. 5*a*, the front surface (27) of the ram block (7) abuts against the cylindrical surface (340) of the circumferential slot (335) present on a lower section (375) of the inner member (4) proximate the bottom edge (380) thereof. This indicates that the ram blocks are in their final position (which is also referred to as closed) securely in place against the inner member (4). At this point, operations may begin. This is evidence that the mechanical interaction is complete between the outer member and the inner member. This also shows that, to optionally provide a proper seal, the side walls of each one of the ram blocks must abut against the side walls of the adjacent ram block. According to a preferred embodiment of the present invention, the side walls may comprise a sealing material adapted to maintain a leak proof seal between the side walls of each one of the ram blocks.

Figure 5B:
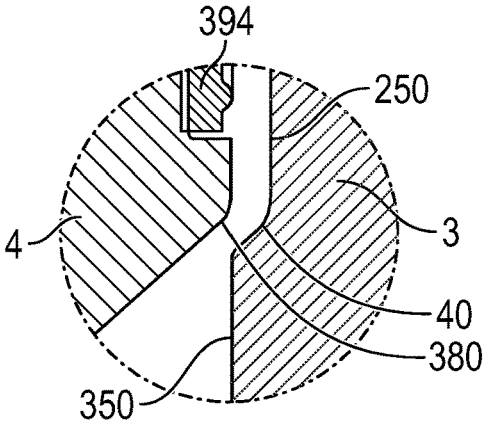

Referring to FIG. 5*b*, one can observe that due to the unique set of features according to the preferred embodiment of the present invention, the bottom edge (380) of the inner member (4), when the latter is secured in place by the actuation of the ram blocks (7), no longer rests on the tapered landing profile (40) of the outer member (3).

Figure 5C:
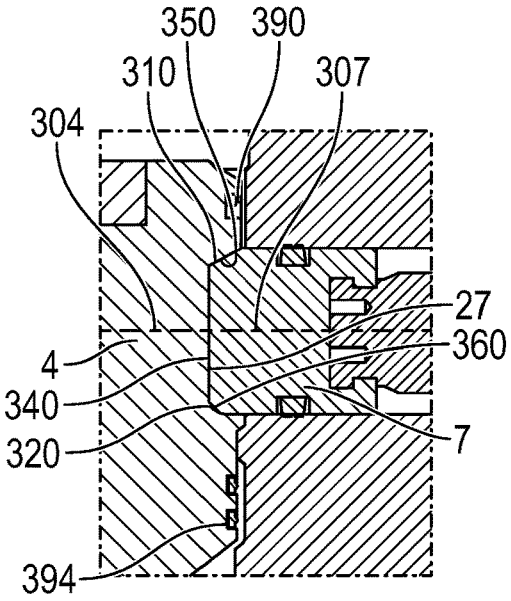

Referring to FIG. 5*c*, this identifies as a close up the inner member (4) and ram block (7), one can observe that the midpoint (304) of the circumferential slot (335) is now aligned with the midpoint (307) of the ram block (7). One also observes, that the upward angled edge (310) of the circumferential slot (335) of the inner member (4) is fully rested on the downward tapered top surface (350) (also referred as front top edge) of the ram block (7), while the bottom surface (360) of the ram block (7) having an upward and inward tapered edge nestles with (or abuts) a downward and outward angled lower face (320) of the circumferential slot (335).

However, once there is then wellbore pressure applied from below the inner member, there is still the need for an impeding profile in the inner member to interact with the bottom edge of the ram blocks to prevent vertical axial upward movement of the inner member in the event that friction alone between the inner surface of the ram blocks and the cylindrical surface of the circumferential slot is not a reliable method of retaining the inner member.

Figure 6:
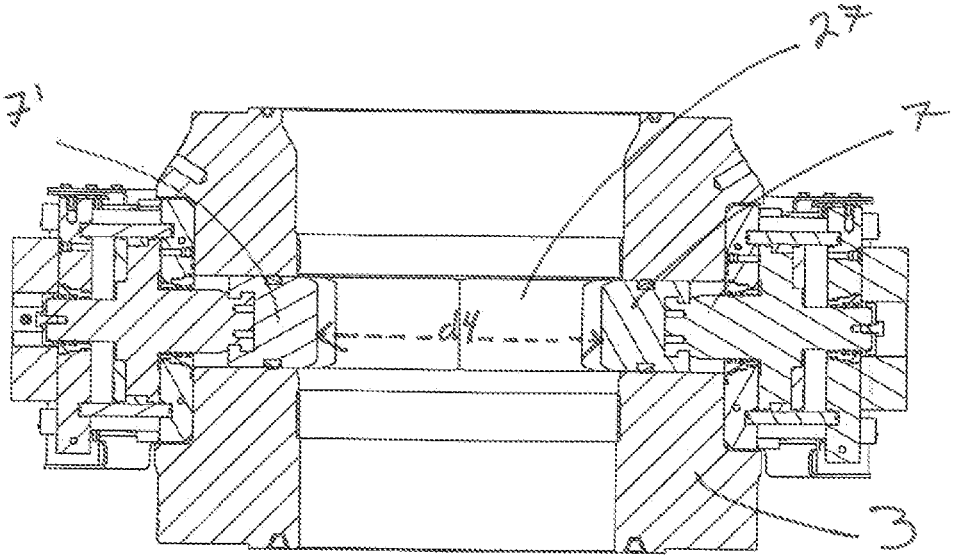
FIG. 6 is a cross-sectional side view of the outer member for use in a RCD according to a preferred embodiment of the present invention where the ram blocks are in a fully extended closed position in the absence of an inner member.
Figure 9:
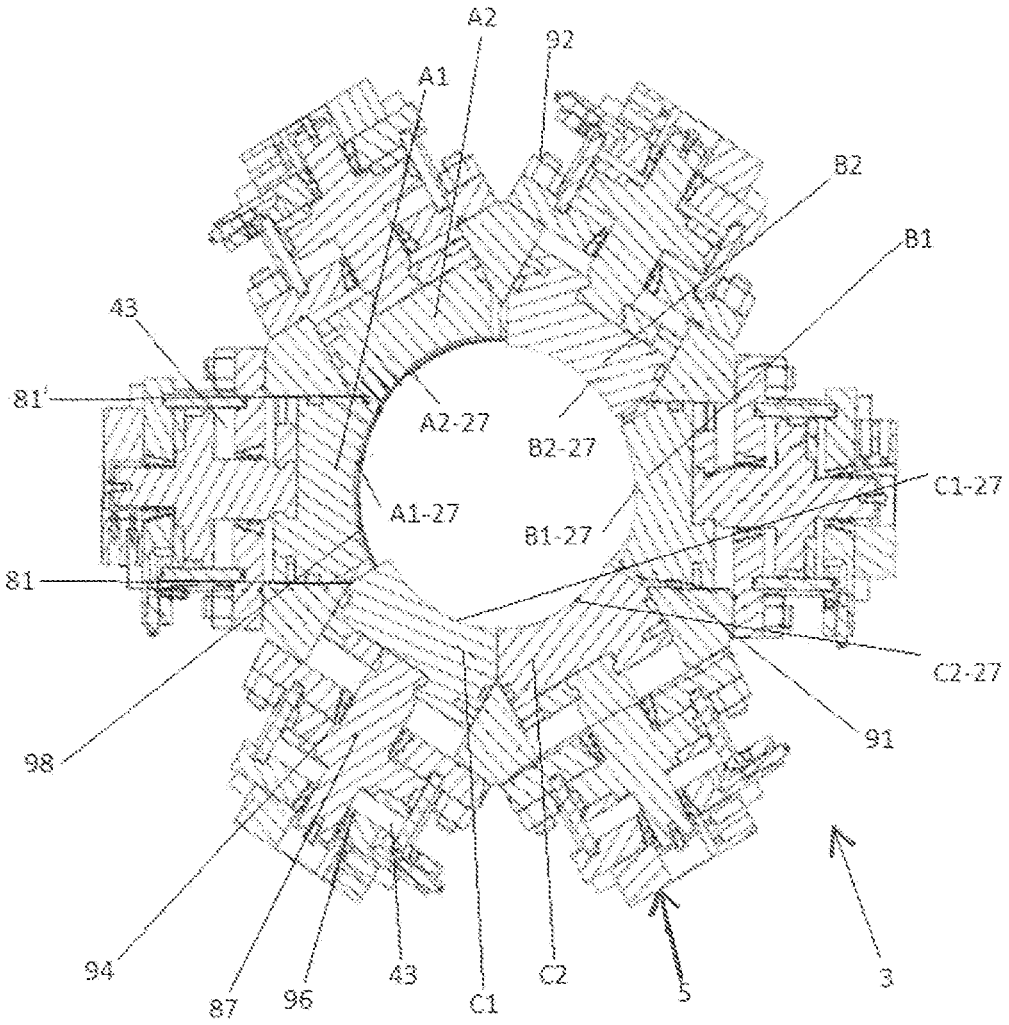
FIG. 9 is a top cross-sectional view of the outer member for use in a RCD according to a preferred embodiment of the present invention.
Figure 10:
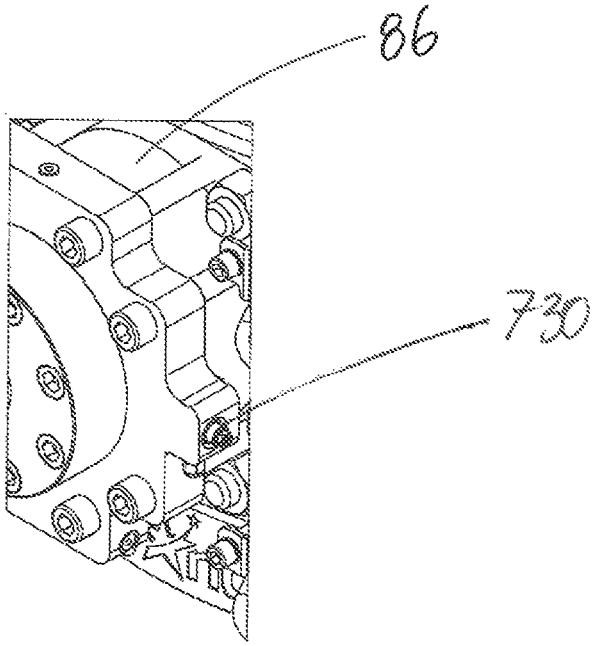
FIG. 10 is a close up of the cartridge valve for use in a RCD according to a preferred embodiment of the present invention.

Now referring to FIG. 6, there is shown is a cross-sectional side view of the outer member (3) for use in a RCD according to a preferred embodiment of the present invention where the ram blocks (7) are in a fully extended closed (i.e. locked) position in the absence of an inner member. According to a preferred embodiment of the present invention, ram blocks (7, 7') can be put in a closed position while there is no inner member inserted inside to be retained by the outer member. Preferably, the plurality of ram blocks are mechanically interlocked with each other to form a complete circular aperture (as can be seen in FIG. 9) which has a fourth diameter (d4) as seen in FIG. 6. This fourth diameter is smaller than the seal receiving sections (255 and 265) having said second diameter (d2) as shown in FIG. 2 to protect these surfaces from contact by objects moving axially through the central bore of the outer member which would normally be accomplished by the use of a bore protector. The seal receiving sections (255 and 265) are intended on receiving seals located on the inner member (4). The preferred embodiment of FIGS. 3*a*, 3*b*, 3*c*, 4*a*, 4*b*, 4*c*, 5*a*, 5*b* and 5*c*, show an upper single seal (390) located above the circumferential slot (335) and a lower double seal (392 and 394) located below the circumferential slot (335).

As can be seen in FIG. 6, the integral piston/rod extends both inwardly and outwardly from the ram block cylinder assembly. The outward extension serves as a means to detect the open or closed position of the ram block cylinder assembly. The inward extension serves as a means of attachment of the ram block. Preferably, inductive proximity sensor can be employed, such sensors are selected from a group consisting of: mechanically-actuated pneumatic valves, magnetic hall effect sensors, Eddy-current sensors, capacitive sensors, photoelectric sensors, ultrasonic sensors, linear position sensors (resistive potentiometers, magneto restrictive sensors). FIG. 7 provides a close up of the arrangement of a sensor (710) according to a preferred embodiment of the present invention.

As seen in FIG. 7, a close-up of a cross-section of a ram block cylinder assembly (5) used in the assembly according to the present invention. The cylinder housing (86) includes an integral cavity adapted to accept a cartridge valve (730 in FIG. 10) with load holding/locking functionality. In the event of an absence of external hydraulic power the cartridge valve maintains ram block position and load bearing capacity in a fail locked condition. It is to be understood that the term "absence" as used above is intended on covering the normal operating condition where the hydraulic circuit is only energized when moving the ram blocks between positions as well as the abnormal operating condition where an absence of external hydraulic power could be caused by a damaged line, failure of the remote power unit, etc. According to a preferred embodiment, the cartridge valve is located elsewhere.

According to a preferred embodiment, the outer member includes an integral cavity adapted to accept a cartridge valve with load holding/locking functionality. In the event of an absence of external hydraulic power the cartridge valve maintains ram block position and load bearing capacity in a fail locked condition.

According to another preferred embodiment, when in the closed position, the ram block not only supports the inner member located within the RCD bowl, but also forms a seal which is leak proof due to seals (not shown) on the inner face (27) of FIG. 8 and on the sides (83) of the ram block. Preferably, this arrangement eliminates the need for high pressure seals below the ram blocks.

FIG. 8 illustrates a perspective side view of a preferred embodiment of a ram block cylinder assembly (5) used in the assembly according to the present invention. The ram block cylinder assembly (5) comprises the ram block (7) and the cylinder housing (86). The cylinder housing (86) comprises the means to move the ram block (7) from a first position where the ram block is fully retracted within the outer member of the rotating control apparatus and a second position where the ram block is fully extended into the aperture defined in the outer member and interlocks with adjacent ram blocks.

According to the preferred embodiment illustrated in FIGS. 8 and 9, the ram block comprises a curved front surface (27) adapted to abut against the outer surface of an inner member when in operation. Preferably, the front surface (27) has a beveled edge (31). The ram block (7) also comprises two side surfaces (84) each of which having a protrusion (81) and a cavity (82) adapted for insertion into the cavity and protrusion of adjacent ram blocks. According to a preferred embodiment, there is an angled surface (83) separating the presence of protrusions and cavities on each ram block allows for an interlocking of ram blocks with one another providing a structural locking of the ram blocks when each one is fully extended. This way, ram blocks when interlocked with one another provide a much more secure lock with the inner member and thus minimizes potential damages caused by torsion forces exerted on the inner member during operations. The ram block also comprises a seal (29) which surrounds the body of the ram block (sides (84), top and bottom (85) so as to provide a seal between the barrier fluid chamber (720 in FIG. 7) and the wellbore.

FIG. 9 is a top cross-sectional view of an outer member showing pairs of ram blocks (pair A1 and A2, pair B1 and B2 and pair C1 and C2) each of which are at a different stage of extension through their housing. The ram block pair A1 and A2 can be seen to be fully retracted within their respective housing and the protrusions (81 and 81') can clearly be seen on their sides. They are considered to be independent from one another as they have no structural interaction, i.e. no interlocking of any kind between one another at this point. Their front surfaces (A1-27 and A2-27) are within the outer member's (3) inner circumference.

The ram blocks of pair B (B1 and B2) can be seen to be extending from their housing (53 and 53') but the protrusions (not labeled) can still be clearly seen on their sides. They are still considered to be independent from one another as they have no structural interaction, i.e. no interlocking of any kind between one another at this point. Their front surfaces (B1-27 and B2-27) extend beyond the outer member's inner circumference.

The ram blocks of pair C (C1 and C2) can be seen to be fully extended from their housing and their protrusions can no longer be seen on their sides. They are considered to no longer be independent from one another as they have structural interaction, there is interlocking between them as the protrusion of ram block C1 is fully inside the corresponding cavity found of ram block C2 at this point. Their front surfaces (C1-27 and C2-27) form a semi-circle as is expected when adjacent ram block are fully extended. To note, as can be seen, in the space between ram block C2 and ram block B1 the protrusion (91) located on ram block C2 has already started its insertion into the corresponding cavity located on ram block B1, there is a beginning of a structural interaction between these two adjacent ram blocks.

Also seen in FIG. 9, bolts (92) to secure piston chamber assembly (5) to the outer member (3).

Connected to ram block C1 are the piston (87), piston plate (99) adapted to sealingly fit into the piston chamber (43). A pair of inner seals (94) and outer seals (96) located around the inner and outer walls respectively of the chamber to provide a seal to the piston (87) as it moves the ram block from a first "open" position to a second "closed" position upon actuation of the ram block (7). A large space (43) is seen in the chamber due to the movement of the piston and, correspondingly, the piston plate (99) to position the ram block C1 in a closed position. Looking at the piston chamber of ram block A1, one notes that the space is in front of the piston plate as the ram block is completely retracted within its housing. The inner seal and outer seals located on the piston are positioned to sealingly engage the front and back walls (respectively) of the piston cylinder chamber throughout the entire range of movement of a ram block.

The piston plate can be integrally mounted on the piston or assembled thereon. Preferably, located within a mid-section of the piston and adapted to fit within the piston chamber so as to abut against each of the internal surfaces of the piston chamber.

As would be understood by the person skilled in the art, the protrusion and cavities on the ram blocks can take many different types of shapes so long as they are adapted to fit into an adjacent ram block. A ram block having alternating protrusions and cavities (i.e. on one side the protrusion is at the top and on the other side of the ram block the protrusion is at the bottom) may be desirable as it allows one type of ram block to be used throughout the device. Alternatively, a ram block may have only one protrusion on one side and one cavity of the opposite side. Another alternative is that the ram blocks have no protrusion nor any cavities. Any number of possible alternatives are considered to be within the scope of this invention depending on the expected use and requirements.

Preferably, the ram blocks have a sealing element (29) (as seen in FIG. 8) to sealingly engage with the ram block housing (identified as a secondary cavity (227, 227') as seen in FIG. 2) to prevent contamination of the barrier fluid chamber from solids and liquids from the wellbore. Any type of material capable of withstanding the pressures and temperatures which RCD will undergo can be used as sealing material.

According to a preferred embodiment of the present invention, the ram block assembly can be removed from the outer member by removing the bolts securing the assembly to the outer member and sliding the ram block out from its housing and disconnecting the hydraulic fluid inlet and outlet hoses.

As is understood by the person skilled in the art to which this disclosure is addressed, the sealing member described and disclosed in this description can take different forms but still be considered to be part of the inventive concept as described and illustrated herein. The embodiments described herein are to be understood to be exemplary and numerous modification and variations of the present invention are possible in light of the above teachings. It is therefore to be understood that within the scope of the claims appended hereto, the invention may be practiced otherwise than as specifically disclosed herein.

The invention claimed is:

1. A rotating control device assembly comprising a retaining system, said assembly comprising:

an outer member; and an inner member;

at least two retaining members;

said outer member comprising:

a top surface adapted for connection with a flange or clamp, which also defines an aperture having a first diameter adapted to accommodate the insertion and removal of the inner member;

an inner cylindrical surface defining a primary cavity and having a first diameter;

an inner circular side wall having a second diameter, said inner circular side wall being located directly under said inner cylindrical surface and inner circular said side wall comprising an inwardly and downwardly tapered section, located below said at least two retaining members;

an outer wall;

a bottom surface adapted for connection with a flange or clamp;

at least two secondary cavities extending through said inner cylindrical surface and outer wall each adapted to surround and support one of said at least two retaining members, said at least two secondary cavities being in connection with said primary cavity and being perpendicular thereto;

at least two retaining members capable of moving within a corresponding one of said at least two secondary cavities between a closed position and an open position, where said at least two retaining members are adapted to abut and lock said inner member inserted inside said primary cavity when in a closed position and allowing said inner member to be inserted into or removed from said primary cavity of said outer member when the at least two retaining members are in the open position;

a tapered landing profile which establishes a penultimate installation position of the inner member when such is inserted in said primary cavity and abutted thereon;

wherein said bottom surface being located below said at least two retaining members and having a third diameter, which is lesser than said first and second diameters;

wherein the at least two retaining members when moved from an open to a closed position abut with the inner member to move the inner member to a final retaining position said inner member comprising:

a circular body;

a first sealing element and a second sealing element adapted to sealingly abut against said inner circular side wall of said outer member; said inner member, first sealing element and second sealing element surrounding said circular body and being rotatable relative to said outer member;

a bottom edge;

a circumferential slot, located proximate said bottom edge, comprising:

a cylindrical center section;

an upward and outward angled upper face adapted to abut with said retaining members when said at least two retaining members are moved from said open position to said closed position; and a downward and outward angled lower face adapted to abut with said retaining members when said at least two retaining members are moved from said open position to said closed position a tapered bottom surface adapted to engage with said tapered landing profile of the outer member which establishes said penultimate installation position of the inner member;

said retaining member comprising:

an inner surface adapted and profiled to abut with said inner member;

a first and second side wall, where each one of said first and second side walls comprises a protrusion and a cavity adapted to mechanically engage with a cavity and a protrusion of an adjacent retaining member when said at least two retaining members are in the closed position;

a top surface having a downward and inward tapered edge a bottom surface, having an upward and inward tapered edge a shape adapted to extend through said secondary cavity of said outer member and into said primary cavity of said outer member.

2. The rotating control device assembly according to claim 1, where the bottom surface of the inner member abuts with the tapered landing profile of the outer member to establish said penultimate installation position, wherein said tapered landing feature providing an installation margin or window, negating the effect of an accumulation of material.

3. The rotating control device assembly according to claim 1, wherein said tapered landing profile is also radiused.

4. A rotating control device assembly according to claim 1, where each one of said at least two retaining members being actuated by a piston adapted to move the retaining member from the open position to the closed position.

5. The rotating control device assembly according to claim 1, wherein the the retaining member assembly comprises: a cylinder housing, and a piston-rod arrangement.

6. The rotating control device assembly according to claim 5, wherein the cylinder housing comprises the means to move the retaining member from a first position where the retaining member is fully retracted within the outer member of the rotating control apparatus and a second position where the retaining member is extended to a closed position into said main cavity.

7. The rotating control device assembly according to claim 1, where when each one of said at least two retaining members is moved from said open position to said closed position, the top surface of the retaining member having a downward and inward tapered edge abuts on the upward and outward tapered edge of the circumferential slot of the inner member, causing the inner member to be driven axially upward to its final retained position.

8. The rotating control device assembly according to claim 1, wherein when said at least two retaining members are in the closed position they effect a complete circular abutment with the cylindrical center section of the circumferential slot of the inner member.

9. The rotating control device assembly according to claim 1, wherein when said at least two retaining members are in the closed position they affix the inner member in place and prevent any axial movement of said inner member within the primary cavity.

10. The rotating control device assembly according to claim 1, wherein when said at least two retaining members are in the closed position, radial force is maintained to the inner member to restrict rotational movement of the inner member in relation to the outer member by frictional contact between the inner surface of said at least two retaining members and the cylindrical surface of the circumferential slot of the inner member.

11. A rotating control device assembly according to claim 1, wherein when said at least two retaining members are in the closed position, radial force is maintained to the inner member to restrict rotational movement of the inner member in relation to the outer member by frictional contact between said retaining member top surface having a downward and inward tapered edge and the upward and outward angled upper face of the circumferential slot of the inner member and the retaining member bottom surface optionally, having an upward and inward tapered edge and the downward and outward angled lower face of the inner member.

12. A rotating control device assembly according to claim 1, wherein when each one of said plurality of ram blocks are in the closed position in the absence of said inner member, each one of said at least two retaining members are mechanically interlocked with an adjacent retaining member to form a complete circular aperture which has a diameter smaller than the seal receiving diameters of the outer member to protect these surfaces from contact by objects moving axially through the primary cavity of the outer member.

13. The rotating control device assembly according to claim 1, wherein the piston/rod arrangement extends both inwardly and outwardly from the ram block cylinder assembly.

14. The rotating control device assembly according to claim 1, wherein the cylinder housing includes an integral cavity adapted to accept a cartridge valve with load holding/locking functionality.

15. The rotating control device assembly according to claim 1, wherein the means to move said retaining member are selected from the group consisting of devices adapted to impart linear movement comprising one or more of the following means of actuation: air-actuated; hydraulic; electrical; a wormgear or any other actuator adapted for this purpose.

16. The rotating control device assembly according to claim 1, wherein the retaining member comprises a body and a concave front surface adapted to abut against the cylindrical surface of an inner member circumferential slot when in the closed position.

17. The rotating control device assembly according to claim 16, wherein the ram block further comprises two side surfaces each of which having a protrusion and a cavity adapted for interlocking into a corresponding cavity and a corresponding protrusion of an adjacent retaining member.

18. The rotating control device assembly according to claim 16, wherein the body of said retaining member comprises two opposite sides, a top, a bottom, and a seal which surrounds the retaining member body to provide a sealing engagement with an outer member secondary cavity to prevent fluid and solids migration between the wellbore and the cylinder chamber.

19. The rotating control device assembly according to claim 1, wherein each one of said at least two retaining members further comprise a seal on said concave front surface.

20. A method of securing a sealing assembly or accessory inside a rotating control device apparatus, said method comprising the steps of:

providing a rotating control device assembly comprising a retaining system, said assembly comprising:

an outer member;

an inner member;

at least two retaining members, such as a ram block;

said outer member comprising:

a top surface adapted for connection with a flange or clamp, which also defines an aperture having a first diameter adapted to accommodate the insertion and removal of the inner member;

an inner cylindrical surface defining a primary cavity;

an inner circular side wall having a second diameter, and said side wall comprising an inwardly and downwardly tapered section, located below said at least two retaining members;

an outer wall;

a bottom surface adapted for connection with a flange or clamp;

at least two secondary cavities extending through the inner cylindrical surface and outer wall adapted to surround and support said at least two retaining members, said secondary cavities being in connection with said primary cavity and being perpendicular thereto;

at least two retaining members capable of moving within a corresponding one of said at least two secondary cavities between a closed position and an open position, where the at least two retaining members are adapted to abut and lock said inner member inserted inside said primary cavity when in a closed position and allowing said inner member to be inserted into or removed from the outer member when the at least two retaining members are in the open position;

a tapered landing profile which establishes a penultimate installation position of the inner member when such is inserted in said aperture and abutted thereon;

wherein said bottom surface being located below said at least two retaining members and having a third diameter, which is lesser than said first and second diameters;

wherein the at least two retaining members when moved from an open to a closed position abut with the inner member to move the inner member to a final retaining position said inner member comprising:

a circular body;

a first sealing element and a second sealing element adapted to sealingly abut against said inner circular side wall of said outer member; said inner member, first sealing element and second sealing element surrounding said circular body and being rotatable relative to said outer member;

a bottom edge;

a circumferential slot, located above said bottom edge, comprising:

a cylindrical center section;

upward and outward angled upper face adapted to abut with said retaining members when said at least two retaining members are moved from said open position to said closed position; and a downward and outward angled lower face adapted to abut with said retaining members when said at least two retaining members are moved from said open position to said closed position a bottom edge which is tapered bottom surface adapted to engage with the tapered landing profile of the outer member which establishes the penultimate installation position of the inner member said retaining member comprising:

an inner surface adapted and profiled to abut with said inner member;

a first and second side wall, where each one of the first and second side walls comprises a protrusion and a cavity adapted to mechanically engage with a cavity and a protrusion of an adjacent retaining member when said at least two retaining members are in the closed position;

a top surface having a downward and inward tapered edge a bottom surface having an upward and inward tapered edge a shape adapted to extend through said secondary cavity of said outer member and into the primary cavity of said outer member an outer groove adapted to accept a seal which engages on said one of at least two cavities extending through the side wall of said outer member, inserting said inner member into said primary cavity;

abutting said bottom edge of said inner member onto said tapered landing profile of said outer member;

actuating said at least two retaining members to move such from an open position to a closed position;

wherein during said actuating step, each one of said at least two retaining members comprising a downwardly and inwardly tapered top surface which abuts against a top edge of said circumferential slot and further movement of the retaining members towards said cylindrical center section of said inner member lifts said bottom edge off of said tapered landing profile of said outer member;

stopping the movement of said at least two retaining members when such reach and abut against said cylindrical center section of said inner member; and stopping the movement of said at least two retaining members when such reach and abut against the ram block top surface having a downward and inward tapered edge and the upward and outward angled upper face of the circumferential slot of the inner member and the ram block bottom surface having an upward and inward tapered edge and the downward and outward angled lower face of the inner member;

wherein, in the closed position, the bottom edge of said inner member does not abut against said tapered landing profile.

21. The process according to claim 20, where said cylindrical center section comprises a mid-point which, upon insertion of said inner member and abutment onto said tapered landing profile of said outer member, will be located in a position under a mid-point defined by said inner surface of said retaining member; and wherein, upon said retaining member being in a closed position and abutting against said cylindrical center section of said circumferential groove, said mid-point of said inner surface of said retaining member and said midpoint of said cylindrical center section of said circumferential groove will be in alignment.

* * * * *